US011946656B2

(12) United States Patent
Zhou et al.

(10) Patent No.: US 11,946,656 B2
(45) Date of Patent: Apr. 2, 2024

(54) AUXILIARY MOUNTING DEVICE AND MOUNTING METHOD FOR SADDLE-TYPE WINDOW AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Shutao Zhou, Qingdao (CN); Wei Guo, Qingdao (CN); Long Zhang, Qingdao (CN)

(73) Assignees: QINGDAO HAIER AIR CONDITIONER GENERAL CORP., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 364 days.

(21) Appl. No.: 17/607,587

(22) PCT Filed: Apr. 9, 2020

(86) PCT No.: PCT/CN2020/083986

§ 371 (c)(1),
(2) Date: Oct. 29, 2021

(87) PCT Pub. No.: WO2020/220965

PCT Pub. Date: Nov. 5, 2020

(65) Prior Publication Data

US 2022/0205652 A1 Jun. 30, 2022

(30) Foreign Application Priority Data

Apr. 29, 2019 (CN) ..... 201910353186.1

(51) Int. Cl.
*F24F 1/031* (2019.01)
*F24F 13/32* (2006.01)

(52) U.S. Cl.
CPC ..... *F24F 1/031* (2019.02); *F24F 13/32* (2013.01); *F24F 2221/20* (2013.01)

(58) Field of Classification Search
CPC .... F24F 1/031; F24F 1/03; F24F 1/027; F24F 1/0314; F24F 13/32; F24F 2221/20; F24F 2221/32; F24F 2013/242; F25B 2500/13
See application file for complete search history.

(56) References Cited

U.S. PATENT DOCUMENTS 5,167,131 A 12/1992 Karkhanis
5,582,025 A * 12/1996 Dubin ..... F24F 13/32 62/262

(Continued)

FOREIGN PATENT DOCUMENTS

CN 203848443 U 9/2014
CN 104930606 A 9/2015

(Continued)

OTHER PUBLICATIONS

WO-2018133140-A1 English Translation (Year: 2018).*

(Continued)

*Primary Examiner* — David J Teitelbaum
*Assistant Examiner* — Devon Moore
(74) *Attorney, Agent, or Firm* — ALSTON & BIRD LLP

(57) ABSTRACT

An auxiliary mounting device and mounting method for a saddle-type window air conditioner. The auxiliary mounting device comprises a base and two damping assemblies; the base is provided on a window, one of the damping assemblies is provided on one end of a connecting portion close to an indoor portion, and ends thereof are respectively connected to the base and the indoor portion; and the other damping assembly is provided on one end of the connecting portion close to an outdoor portion, and ends thereof are respectively connected to the base and the outdoor portion. During mounting, the two damping assemblies are first mounted onto the connecting portion, two ends of each damping assembly are respectively connected to the base and the indoor portion or the outdoor portion, then the saddle-type window air conditioner and the auxiliary mounting device are moved together onto the window, the base sits on the window, the saddle-type window air conditioner moves downwards under the action of gravity, thus driving the damping assemblies to stretch, and under the action of the damping assemblies, the connecting portion gradually moves in a direction toward the base, thereby enabling the saddle-type window air conditioner to fall slowly. The auxiliary mounting device has a simple structure and is easy to operate.

10 Claims, 5 Drawing Sheets

(56) References Cited

U.S. PATENT DOCUMENTS

| | | | | |
|---|---|---|---|---|
| 6,389,834 | B1 | 5/2002 | LeClear et al. | |
| 7,992,404 | B2 * | 8/2011 | Su | F24F 1/027 62/262 |
| 2003/0110789 | A1 * | 6/2003 | Cur | F24F 1/027 62/262 |
| 2014/0020421 | A1 * | 1/2014 | Gallo | B23P 11/00 62/263 |
| 2017/0284683 | A1 * | 10/2017 | Gallo | F24F 13/0245 |

FOREIGN PATENT DOCUMENTS

| | | | | |
|---|---|---|---|---|
| CN | 106369689 | A | 2/2017 | |
| CN | 108344053 | A | 7/2018 | |
| CN | 108679746 | A | 10/2018 | |
| CN | 210399226 | U | 4/2020 | |
| WO | WO-2018133140 | A1 * | 7/2018 | F24F 1/027 |

OTHER PUBLICATIONS

International Search Report for PCT/CN2020/083986 (ISA/CN) dated Jul. 8, 2020 with English translation (6 pages).
Written Opinion for PCT/CN2020/083986 (ISA/CN) dated Jul. 8, 2020 with English translation (4 pages).

* cited by examiner

AUXILIARY MOUNTING DEVICE AND MOUNTING METHOD FOR SADDLE-TYPE WINDOW AIR CONDITIONER

CROSS-REFERENCE TO RELATED APPLICATIONS

The present application is a national phase entry of International Application No. PCT/CN2020/083986, filed Apr. 9, 2020, which claims priority to Chinese Patent Application No. 201910353186.1, filed Apr. 29, 2019, which are incorporated herein by reference in their entirety.

FIELD OF THE INVENTION

The present invention relates to the technical field of window air conditioners, and particularly to an auxiliary mounting device and mounting method for a saddle-type window air conditioner.

BACKGROUND OF THE INVENTION

A saddle-type window air conditioner usually includes an indoor part, an outdoor part, and a connecting part. The connecting part is used to connect the indoor part with the outdoor part. The outdoor part and the indoor part are located on the same side of the connecting part. The whole window air conditioner is shaped into an inverted U-shaped structure. After the saddle-type window air conditioner is mounted to a window, the connecting part is located on the window, and both the indoor part and the outdoor part are located below the window, which can prevent the window air conditioner from blocking the sunlight. At present, saddle-type window air conditioners become more and more popular among consumers.

Due to a specific structure of the saddle-type window air conditioner, when the window air conditioner is moved to the window and descends onto the window, the window air conditioner is very likely to descend suddenly to generate a relatively strong impact between the connecting part and the window to further damage the connecting part as well as pipelines, devices, etc., therein.

The above information disclosed in the background art is only used to understand the background art of the present application better, and thus may include information that does not constitute the prior art known to those of ordinary skill in the art.

BRIEF DESCRIPTION OF THE INVENTION

For the risk in the prior art that a saddle-type window air conditioner descends suddenly in a mounting process, the present invention provides an auxiliary mounting device for a saddle-type window air conditioner, so that under the action of a damping component, the saddle-type window air conditioner can descend slowly in the mounting process. The auxiliary mounting device is simple in structure and convenient to operate.

In order to achieve the foregoing invention objective, the present invention is implemented through the following technical solutions:

The present invention provides an auxiliary mounting device for a saddle-type window air conditioner. The saddle-type window air conditioner includes an indoor part located on an indoor side, an outdoor part located on an outdoor side, and a connecting part located on a window. A first end of the connecting part is connected with the indoor part, and a second end of the connecting part is connected with the outdoor part. The auxiliary mounting device includes: a base, located below the connecting part and forming a certain distance from the connecting part; and two damping components. One of the damping components is disposed at the first end of the connecting part, and end portions thereof are connected with the base and the indoor part respectively. The other of the damping components is disposed at the second end of the connecting part, and end portions thereof are connected with the base and the outdoor part respectively. The connecting part moves gradually towards a direction close to the base with stretching of the two damping components.

In order to guide the damping components to move, a guide portion is disposed on the connecting part, and the damping components are partially disposed in the guide portion.

As an embodiment, the damping components include elastic ropes and a depression bar. One of the elastic ropes is disposed at the first end of the connecting part, and end portions thereof are connected with the base and the indoor part respectively. The other of the elastic ropes is disposed at the second end of the connecting part, and end portions thereof are connected with the base and the outdoor part respectively. The depression bar is connected with the connecting part, and the elastic ropes are pressed between the depression bar and the connecting part.

In order to limit the elastic ropes, the depression bar is disposed at a middle position on an upper surface of the connecting part along a length direction of the connecting part, pits are formed at two ends of the depression bar respectively, and the elastic ropes are pressed between the pits and the upper surface of the connecting part.

Further, fixed sheets are disposed on a back plate of the indoor part and a back plate of the outdoor part respectively, first fixing holes are formed in the fixed sheets, and the elastic ropes pass through and are disposed in the first fixing holes. The base is located above the fixed sheets.

Further, second fixing holes are formed in four corners of the base respectively, and the end portions of the elastic ropes are connected with the second fixing holes.

As another embodiment, the damping components include rope components and a depression bar, and the rope components include springs and ropes disposed at two ends of the springs. The spring on one of the rope components is disposed at the first end of the connecting part, and end portions of the ropes are connected with the base and the indoor part. The spring on the other of the rope components is disposed at the second end of the connecting part, and the end portions of the ropes are connected with the base and the outdoor part. The depression bar is connected with the connecting part, and the springs are pressed between the depression bar and the connecting part.

As another embodiment, the damping components include ropes and descent control devices connected with the ropes. The descent control device on one of the damping components is disposed at the first end of the connecting part, and end portions of the rope are connected with the base and the indoor part. The descent control device on the other of the damping components is disposed at the second end of the connecting part, and end portions of the rope are connected with the base and the outdoor part.

As another embodiment, the damping components include first ropes, second ropes, and damping rotating shafts, and the first ropes and the second ropes are wound on the damping rotating shafts in opposite directions. The damping rotating shaft on one of the damping components is disposed at the first end of the connecting part, and end portions of the first ropes and the second ropes are connected with the base and the indoor part respectively. The damping rotating shaft on the other of the damping components is disposed at the second end of the connecting part, and the end portions of the first ropes and the second ropes are connected with the base and the outdoor part.

The present invention further provides a mounting method for mounting a saddle-type window air conditioner using the above-mentioned auxiliary mounting device for the saddle-type window air conditioner. The mounting method includes: mounting one of the damping components to the first end of the connecting part, end portions of the damping component being connected with the base and the indoor part; mounting the other of the damping components to the second end of the connecting part, the end portions of the damping component being connected with the base and the outdoor part; moving the saddle-type window air conditioner to a window together with the base and the two damping components, and placing the base on the window, the indoor part being located on an indoor side, and the outdoor part being located on an outdoor side; and causing the connecting part to move gradually towards a direction close to the base with stretching of the damping components.

Compared with the prior art, the present invention has the following advantages and beneficial effects:

The present invention provides an auxiliary mounting device and a mounting method for a saddle-type window air conditioner. The auxiliary mounting device includes the base and two damping components. The base is located below the connecting part, and forms the certain distance from the connecting part. One of the damping components is disposed at the end, close to the indoor part, of the connecting part, and the end portions thereof are connected with the base and the indoor part respectively. The other of the damping components is disposed at the end, close to the outdoor part, of the connecting part, and the end portions thereof are connected with the base and the outdoor part respectively. During mounting, the two damping components are mounted to the connecting part at first, then the two ends of each damping component is connected with the base, the indoor part and the outdoor part respectively, and then the saddle-type window air conditioner is moved to the window together with the auxiliary mounting device, and the base is located on the window. The saddle-type window air conditioner moves downwards under the action of gravity to stretch the damping components, and under the action of the damping components, the connecting part moves gradually toward the direction close to the base, so that the saddle-type window air conditioner descends slowly. The auxiliary mounting device is simple in structure and convenient to operate.

After reading specific implementation manners of the present invention in combination with the accompanying drawings, other features and advantages of the present invention will be clearer.

BRIEF DESCRIPTION OF THE DRAWINGS

To describe the technical solutions in the embodiments of the present invention or in the prior art clearly, the following briefly describes the accompanying drawings required for describing the embodiments or the prior art. Apparently, the accompanying drawings in the following description show some embodiments of the present invention, and those of ordinary skill in the art may still derive other drawings from these accompanying drawings without creative efforts.

In the figures: 10 denotes an auxiliary mounting device; 111 denotes an elastic rope; 112 denotes a spring; 113 denotes a rope; 114 denotes a descent control device; 115 denotes a damping rotating shaft; 116 denotes a first rope; 117 denotes a second rope; 118 denotes a depression bar; 1181 denotes a pit; 12 denotes a base; 121 denotes a second fixing hole; 20 denotes a saddle-type window air conditioner; 21 denotes an indoor part; 211 denotes a back plate of the indoor part; 22 denotes a connecting part; 221 denotes a first end of the connecting part; 222 denotes a second end of the connecting part; 23 denotes an outdoor part; 231 denotes a back plate of the outdoor part; 24 denotes a fixing piece; 241 denotes a first fixing hole;

W denotes a width direction of the connecting part; L denotes a length direction of the connecting part; and d denotes a distance between the connecting part and the base.

DETAILED DESCRIPTION

In order to make objectives, technical solutions and advantages of embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. All other embodiments obtained by those of ordinary skill in the art based on the embodiments of the present invention without creative efforts shall fall within the protection scope of the present invention.

It is to be noted that, in the descriptions of the present invention, the terms "upper", "lower", "left", "right", "vertical", "horizontal", "inner", "outer", and the like indicating the direction or position relationships are based on the direction or position relationships shown in the accompanying drawings, which is only for the convenience of description, and does not indicate or imply that the devices or elements must be in specific orientations or structured and operated in specific orientations, and thus should not be understood as limits to the present invention. In addition, terms "first" and "second" are used for description only, and cannot be understood as indicating or implying the relative importance.

Figure 1:
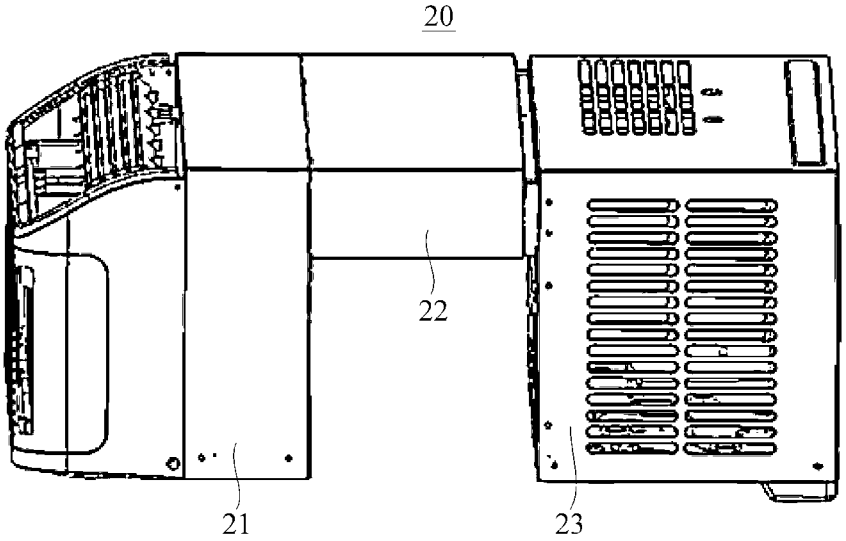
FIG. 1 is a schematic structural diagram of an embodiment of a saddle-type window air conditioner according to the present invention.

The present invention discloses an auxiliary mounting device for a saddle-type window air conditioner, which is applied to a mounting process of the saddle-type window air conditioner. Referring to FIG. 1, the saddle-type window air conditioner 20 includes an indoor part 21, an outdoor part 23, and a connecting part 22. The indoor part 21 is located on an indoor side and below a window. The outdoor part 23 is located on an outdoor side and below the window. The connecting part 22 is used to connect the indoor part 21 with the outdoor part 23. The whole window air conditioner is shaped into an inverted U-shaped structure. The connecting part 22 is available in two forms: retractable and non-retractable forms. When the retractable form is used, a length of the connecting part 22 can be adjusted to be adapted to windows with different sizes. After the saddle-type window air conditioner 20 is mounted to the window, the connecting part 22 is located on the window, and both the indoor part 21 and the outdoor part 23 are located below the window, which can prevent the window air conditioner from blocking the sunlight.

To facilitate the description below, the end, close to the indoor part, of the connecting part 22 is defined as a first end 221 of the connecting part, the end, close to the outdoor part, of the connecting part 22 is defined as a second end 222 of the connecting part, and a length direction L of the connecting part is defined to be from the first end 221 of the connecting part to the second end 222 of the connecting part.

Figure 2:
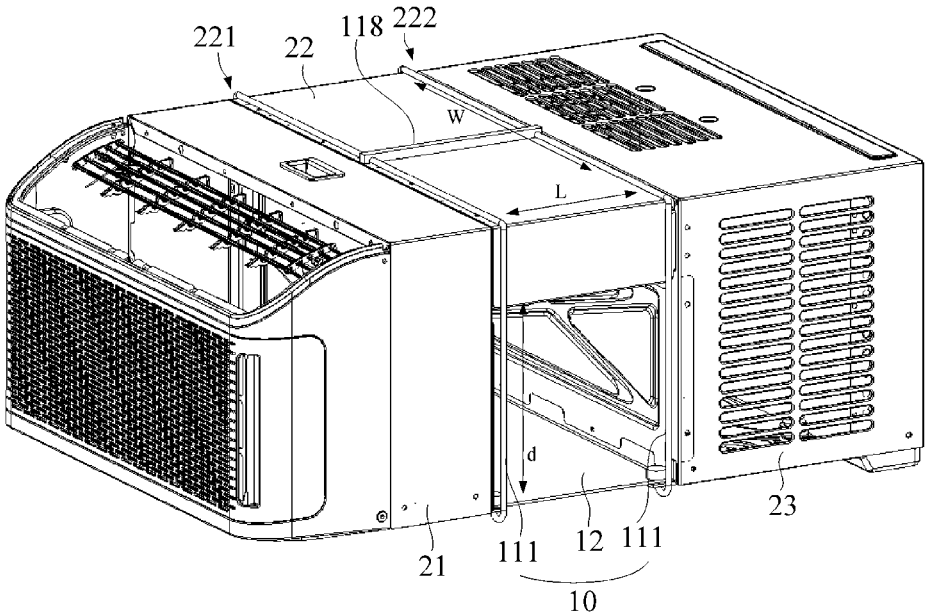
FIG. 2 is schematic structural diagram I of the first embodiment of an auxiliary mounting device for a saddle-type window air conditioner according to the present invention.
Figure 3:
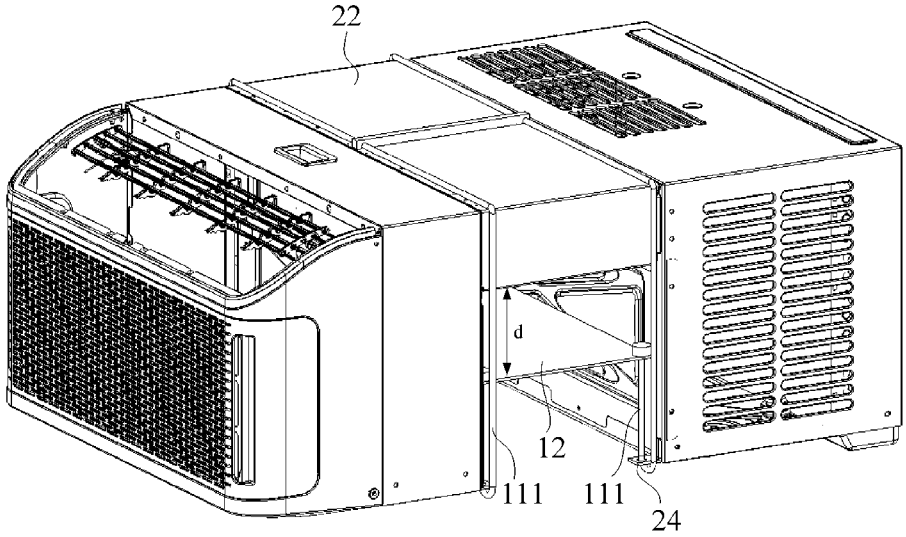
FIG. 3 is schematic structural diagram II of the first embodiment of the auxiliary mounting device for a saddle-type window air conditioner according to the present invention.
Figure 4:
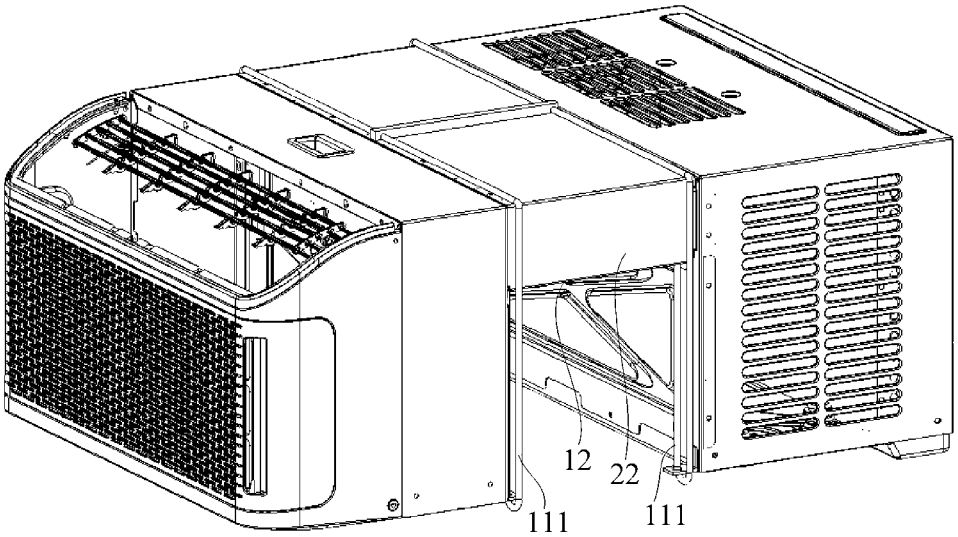
FIG. 4 is schematic structural diagram III of the first embodiment of the auxiliary mounting device for a saddle-type window air conditioner according to the present invention.
Figure 5:
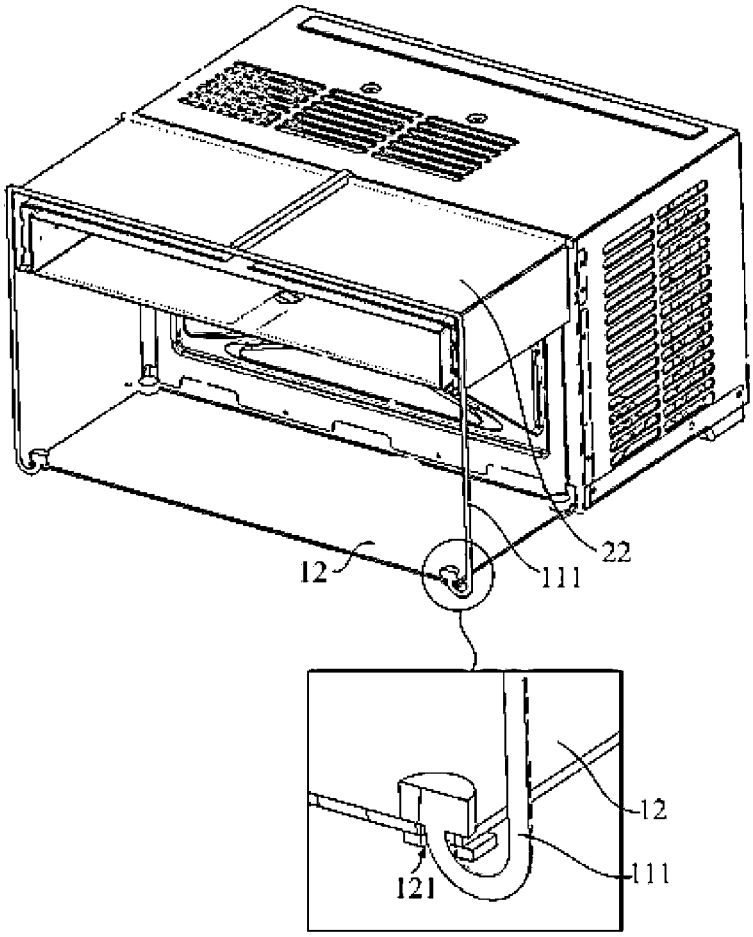
FIG. 5 is schematic structural diagram IV of the first embodiment of the auxiliary mounting device for a saddle-type window air conditioner according to the present invention.

The auxiliary mounting device 10 includes a base 12 and two damping components of the same structure. The base 12 is located below the connecting part 22, and forms a certain distance d from the connecting part 22. One damping component is disposed at the first end 221 of the connecting part, and end portions of the damping component are connected with the base 12 and the indoor part 22 respectively. The other damping component is disposed at the second end 222 of the connecting part, and end portions of the damping component are connected with the base 12 and the outdoor part 23 respectively. Referring to FIG. 2 to FIG. 4, after the auxiliary mounting device 10 is mounted to the saddle-type window air conditioner 20, the damping components are in an original state (i.e., an unstretched state) or a micro-tensile state, and the auxiliary mounting device 10 is moved onto the window together with the saddle-type window air conditioner 20, the base 12 being located on the window. The saddle-type window air conditioner 20 moves downwards under the action of gravity to stretch the damping components, and under the action of the damping components, the connecting part 22 moves gradually toward a direction close to the base 12, that is, a distance d between the base 12 and a lower surface of the connecting part 22 is gradually reduced, so that the saddle-type window air conditioner 20 descends slowly. The auxiliary mounting device 10 is simple in structure and convenient to operate.

A guide portion (not shown in the figures) is disposed on the connecting part 22, and the damping components are partially disposed in the guide portion, so that the damping components are prevented from being deviated in a stretching process, and move more smoothly. The guide portion can be a guide element disposed on an upper surface and/or a sidewall of the connecting part 22, a guide hole is formed in the guide element, the damping components pass through and are disposed in the guide hole, and the damping components are stretched reciprocally along the guide hole. Alternatively, the guide portion can be a groove formed in the upper surface and/or the sidewall of the connecting part 22, the damping components are partially disposed in the groove, and the damping components are stretched reciprocally along the groove.

After the auxiliary mounting device 10 is fixedly mounted to the saddle-type window air conditioner 20, a lower surface of the base 12 is retracted into a lower is surface of the indoor part 21 and a lower surface of the outdoor part 23, so that a low-height inverted U-shaped structure is formed between the base 12 and the indoor part 21 and outdoor part 23. When the saddle-type window air type 20 is placed on the window together with the base 12 and the damping components, the low-height inverted U-shaped structure plays a certain role in positioning and clamping, that is, the saddle-type window air conditioner 20 are preliminarily positioned and clamped on the window, and when the saddle-type window air conditioner 20 moves downwards under the action of gravity, it can be ensured that, after descending, the indoor part 21 is located on the indoor side and may not generate movement interferences to the window, and the outdoor part 23 is located on the outdoor side and may not generate movement interferences to the window.

The present invention provides four embodiments of the auxiliary mounting device for a saddle-type window air conditioner. In the first embodiment, the damping components include elastic ropes 111 and a depression bar 118. In the second embodiment, the damping components include rope components and the depression bar 118, and the rope components include springs 112 and ropes 113 disposed at two ends of the springs 112. In the third embodiment, the damping components include ropes 113 and descent control devices 114 connected with the ropes 113. In the fourth embodiment, the damping components include first ropes 116, second ropes 117 and damping rotating shafts 115, and the first ropes 116 and the second ropes 117 are wound on the damping rotating shafts 115 in opposite directions. The four embodiments will be described below in detail one by one.

First Embodiment

Referring to FIG. 2 to FIG. 6, the damping components include the elastic ropes 111 and the depression bar 118. Since the auxiliary mounting device 10 includes two damping components, in the first embodiment, two elastic ropes 111 are included. One elastic rope 111 is disposed at the first end 221 of the connecting part, and end portions thereof are connected with the base 12 and the indoor part 21 respectively. The other elastic rope 111 is disposed at the second end 222 of the connecting part, and end portions thereof are connected with the base 12 and the outdoor part 23 respectively. The depression bar 118 is connected with the connecting part 22 in a fixing manner of screwing, or clamping, or bonding, etc., and the elastic ropes 111 are pressed between the depression bar 118 and the connecting part 22.

The depression bar 118 plays a role in limiting the elastic ropes 111 to avoid a position deviation of the elastic ropes 111 in a stretching process.

When the saddle-type window air conditioner 20 moves downwards under the action of gravity, the elastic ropes 111 are stressed and stretched, and a tensile force of the elastic ropes 111 reacts on the saddle-type window air conditioner 20, so that the saddle-type window air conditioner 20 descends slowly. With continuous stretching of the elastic ropes 111, the distance d between the base 12 and the lower surface of the connecting part 22 is gradually reduced until the base 12 abuts against the lower surface of the connecting part 22. For the retractable connecting part 22, a length size of the connecting part 22 is readjusted to be adapted to a corresponding window size.

Figure 6:
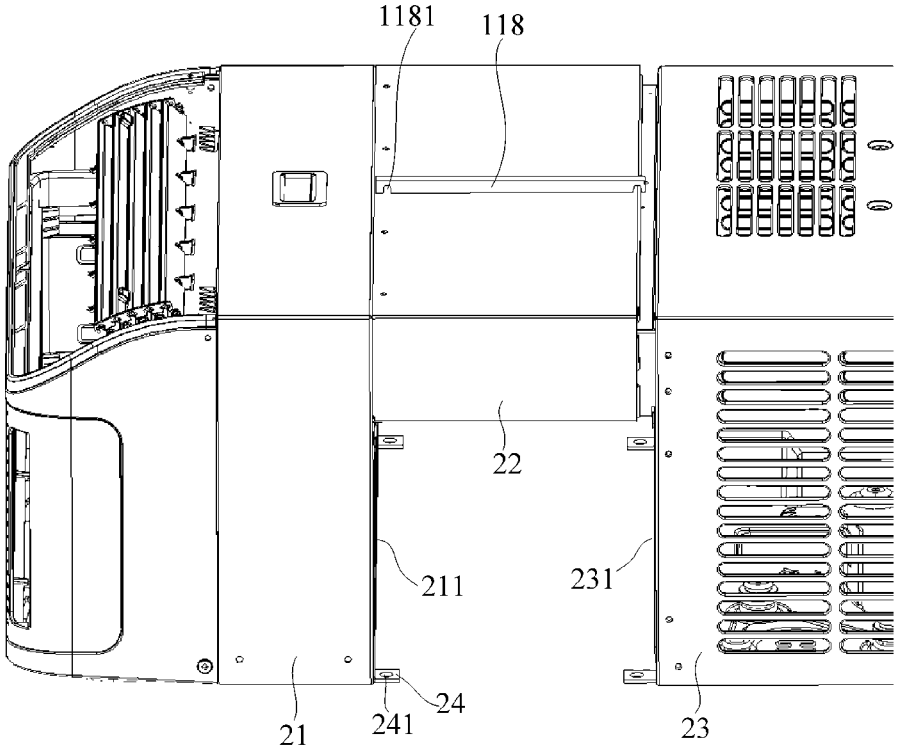
FIG. 6 is schematic structural diagram V of the first embodiment of the auxiliary mounting device for a saddle-type window air conditioner according to the present invention.

There may be two depression bars 118, and each depression bar 118 is used to press one elastic rope 111. Alternatively, there may be one depression bar 118. In the embodiment, there is one depression bar. As a preferred embodiment, the depression bar 118 is disposed at a middle position of the connecting part 22 along the length direction L of the connecting part. In order to conveniently limit the elastic ropes 111, pits 1181 are formed in two ends of the depression bar 118 respectively. Referring to FIG. 6, the elastic ropes 111 are pressed between the pits 1181 and an upper surface of the connecting part 22. Through the pits 1181, the elastic ropes 111 can further be prevented from being deviated. It is to be noted that, when the elastic ropes 111 are disposed in the pits 1181, the elastic ropes 111 can be disposed to be pressed tightly by the pits 1181 and the upper surface of the connecting part 22 and unable to move, or the elastic ropes 111 may be disposed to move leftwards and rightwards between the pits 1181 and the upper surface of the connecting part, as long as it is ensured that the elastic ropes 111 are not deviated in the length direction L of the connecting part. Alternatively, a plurality of depression bars 118 may be disposed, and arranged uniformly along the width direction W of the connecting part, and each depression bar 118 simultaneously presses two elastic ropes 111.

Fixed sheets 24 are disposed on a back plate 211 of the indoor part and a back plate 221 of the outdoor part respectively, first fixing holes 241 are formed in the fixed sheets 24, and end portions of the elastic ropes 111 pass through and are disposed in the first fixing holes 241. The base 12 is located above the fixed sheets 24, so as to avoid movement interferences of the fixed sheets to the base 12 in a descending process of the saddle-type window air conditioner 20. In addition, the fixed sheets 24 should be not too large, so as to avoid movement interferences of the fixed sheets 24 to descending of the saddle-type window air conditioner 20.

Second fixing holes 121 are formed in four corners of the base 12 respectively, and the end portions of the elastic ropes 111 are fixedly connected with the second fixing holes 121. During mounting, the end portions of the elastic ropes 111 penetrate into the first fixing holes 241 at first, then penetrate into the second fixing holes 121, and then the end portions of the elastic ropes 111 are wound and knotted at the second fixing holes 121, so as to prevent the elastic ropes 111 from falling off from the first fixing holes 241 and the second fixing holes 121.

When the elastic ropes 111 simultaneously penetrate into the first fixing holes 241 and the second fixing holes 121, the elastic ropes 111 are preferably in a vertical state in an up-down direction, so that acting forces on the base 12 and the fixing holes 24 can be reduced when the elastic ropes 111 are stretched and deformed, thereby improving the reliability of the device.

Preferably, concave portions (not shown in the figures) are formed in four corners of the lower surface of the connecting part 22. When the connecting part 22 descends to be close to the base 12, knotted positions of the end portions of the elastic ropes 111 are just in the concave portions, so that the base 12 can fit closely with the lower surface of the connecting part 22, and the saddle-type window air conditioner 20 mounted on the window is more stable and beautiful.

The size of the base 12 is set to be no greater than the size of the lower surface of the connecting part 22, so that when the connecting part 22 descends to abut against the base 12, it can be ensured that the base 12 is not exposed, which is more attractive in appearance.

In the second embodiment, the third embodiment and the fourth embodiment, connecting structures between the end portions of the damping components and the base 12, the indoor part 21, and the outdoor part 23 are the same. Therefore, elaborations are omitted, and only differences among them are described.

Second Embodiment

Figure 7:
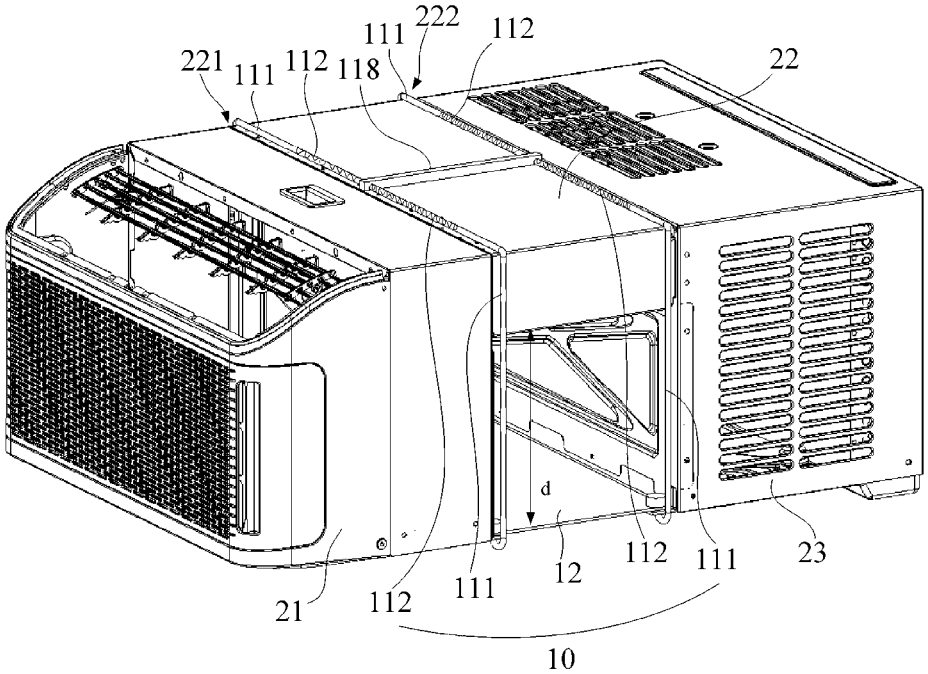
FIG. 7 is a schematic structural diagram of the second embodiment of the auxiliary mounting device for a saddle-type window air conditioner according to the present invention.

Referring to FIG. 7, the damping components include the rope components and the depression bar 118, and the rope components include the springs 112 and the ropes 113 disposed at the two ends of the springs 112. The spring 112 on one rope component is disposed at the first end 221 of the connecting part, and end portions of the ropes 113 disposed at the two ends of the spring 112 are connected with the base 12 and the indoor part 21 respectively. The spring 112 on the other rope component is disposed at the second end 222 of the connecting part, and end portions of the ropes 113 disposed at the two ends of the spring 112 are connected with the base 12 and the outdoor part 23 respectively. The depression bar 118 is connected with the connecting part 22 in the fixing manner of screwing, or clamping, or bonding, etc., and the springs 112 are pressed between the depression bar 118 and the connecting part 22. The depression bar 118 plays a role in limiting the springs 112 to avoid a position deviation of the springs 112 in a stretching process.

When the saddle-type window air conditioner 20 moves downwards under the action of gravity, the springs 112 are stressed and stretched, and a tensile force of the springs 112 reacts on the saddle-type window air conditioner 20, so that the saddle-type window air conditioner 20 descends slowly. With continuous stretching of the springs 112, the distance d between the base 12 and the lower surface of the connecting part 22 is gradually reduced until the base 12 abuts against the lower surface of the connecting part 22. For the retractable connecting part 22, the length size of the connecting part 22 is readjusted to be adapted to the corresponding window size.

Third Embodiment

Figure 8:
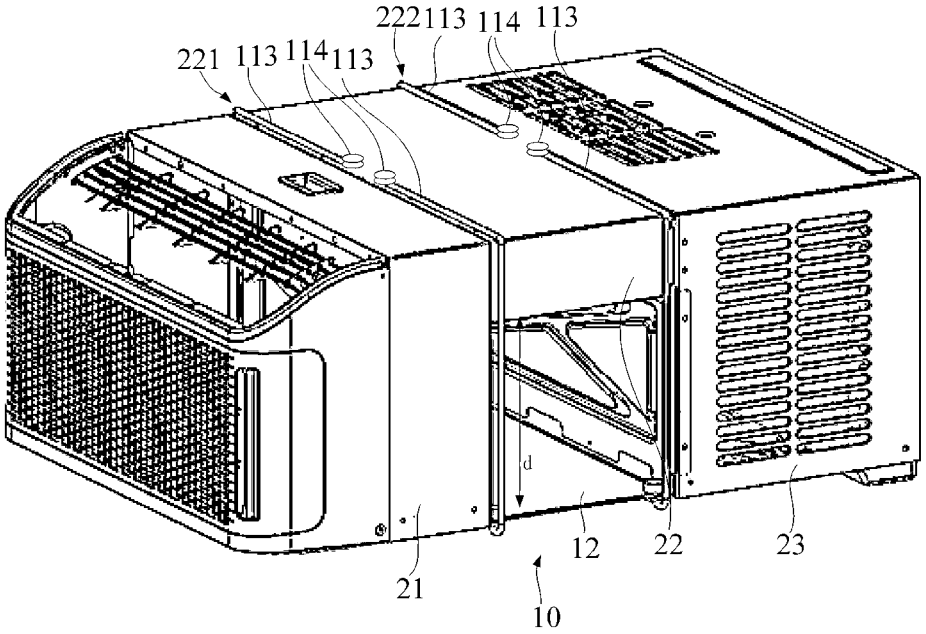
FIG. 8 is a schematic structural diagram of the third embodiment of the auxiliary mounting device for a saddle-type window air conditioner according to the present invention.

Referring to FIG. 8, the damping components include the ropes 113 and the descent control devices 114 connected with the ropes 113. Each damping component includes two descent control devices 114, and each descent control device 114 is connected with one rope 113. The two descent control devices 114 on one damping component are disposed on an upper surface of the first end 221 of the connecting part, and the two ropes 113 are connected with the base 12 and the indoor part 21 respectively. The two descent control devices 114 on the other damping component are disposed on an upper surface of the second end 222 of the connecting part, and the two ropes 113 are connected with the base 12 and the outdoor part 23 respectively.

When the saddle-type window air conditioner 20 moves downwards under the action of gravity, the ropes 113 extend out slowly under the action of the descent control devices 114, and as the ropes 113 extend out continuously, the distance d between the base 12 and the lower surface of the connecting part 22 is gradually reduced, so that the saddle-type window air conditioner 20 descends slowly until the base 12 abuts against the lower surface of the connecting part 22. For the retractable connecting part 22, a length size of the connecting part 22 is readjusted to be adapted to a corresponding window size.

Fourth Embodiment

Figure 9:
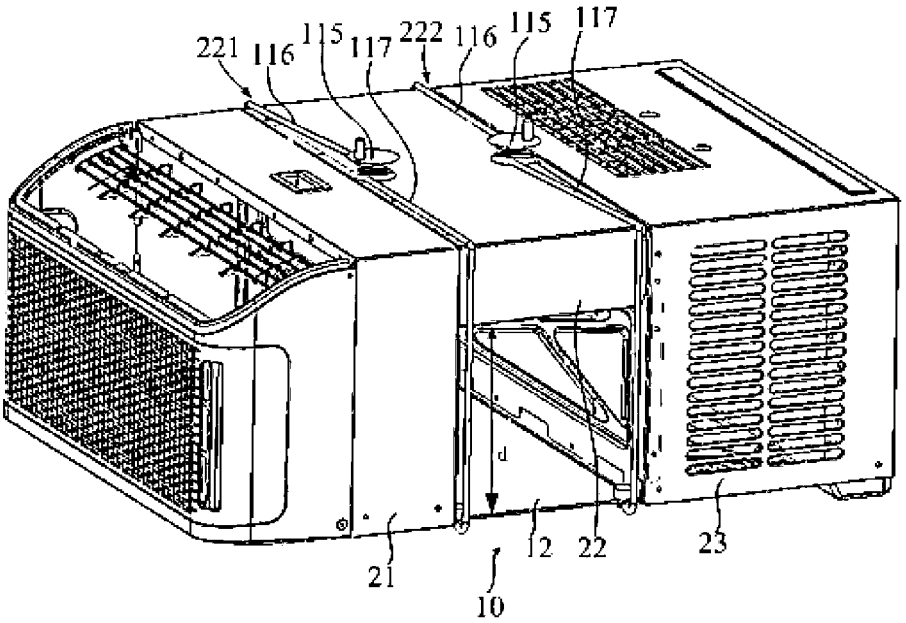
FIG. 9 is a schematic structural diagram of the fourth embodiment of the auxiliary mounting device for a saddle-type window air conditioner according to the present invention.

Referring to FIG. 9, the damping components include the first ropes 116, the second ropes 117 and the damping rotating shafts 115, and the first ropes 116 and the second ropes 117 are wound on the damping rotating shafts 115 in opposite directions. The damping rotating shaft 115 on one damping component is disposed on the upper surface of the first end 221 of the connecting part, and end portions of the first ropes 116 and the second ropes 117 are connected with the base 12 and the indoor part 21 respectively. The damping rotating shaft 115 on the other damping component is disposed on the upper surface of the second end 222 of the connecting part, and end portions of the first ropes 116 and the second ropes 117 are connected with the base 12 and the outdoor part 23 respectively.

When the saddle-type window air conditioner 20 moves downwards under the action of gravity, the first ropes 116 and the second ropes 117 spin out slowly under the action of the damping rotating shafts 115, and as the first ropes 116 and the second ropes 117 spin out continuously, the distance d between the base 12 and the lower surface of the connecting part 22 is gradually reduced, so that the saddle-type window air conditioner 20 descends slowly until the base 12 abuts against the lower surface of the connecting part 22. For the retractable connecting part 22, the length size of the connecting part 22 is readjusted to be adapted to the corresponding window size.

A mounting method for an auxiliary mounting device for a saddle-type window air conditioner includes:

- mounting one damping component to a first end 221 of a connecting part, end portions of the damping component being connected with a base 12 and an indoor part 22;
- mounting the other damping component to a second end 222 of the connecting part, end portions of the damping component being connected with the base 12 and an outdoor part 23;
- moving the saddle-type window air conditioner 20 to a window together with the auxiliary mounting device 10, and placing the base 12 on the window, the indoor part 21 being located on an indoor side, and the outdoor part 23 being located on an outdoor side; and
- causing the connecting part 22 to gradually move towards a direction close to the base 12 with stretching of the damping components.

It should be illustrated finally that, the above embodiments are only used for illustrating the technical solutions of the present invention, and are not intended to limit the present invention. Although the present invention is illustrated in detail with reference to the foregoing embodiments, it should be understood by those skilled in the art that, modifications may still be made on the technical solutions recited in the foregoing embodiments, or equivalent replacements are made on part of the technical features; and these modifications or replacements do not make the essence of the corresponding technical solutions break away from the spirit and scope of the technical solution of the various embodiments of the present invention.

The invention claimed is:

1. An auxiliary mounting device for a saddle window air conditioner, the saddle window air conditioner comprising an indoor part located on an indoor side, an outdoor part located on an outdoor side, and a connecting part located on a window, a first end of the connecting part being connected with the indoor part, and a second end of the connecting part being connected with the outdoor part, wherein the auxiliary mounting device comprises:

a base, located below the connecting part and forming a certain distance from the connecting part; and two damping components, wherein one of the damping components is disposed at the first end of the connecting part, and end portions thereof are connected with the base and the indoor part respectively; and the other of the damping components is disposed at the second end of the connecting part, and end portions thereof are connected with the base and the outdoor part respectively; and the connecting part moves gradually towards a direction close to the base with stretching of the two damping components.

2. The auxiliary mounting device for the saddle type window air conditioner according to claim 1, wherein a guide portion is disposed on the connecting part, and the damping components are partially disposed in the guide portion.

3. The auxiliary mounting device for the saddle window air conditioner according to claim 1, wherein the damping components comprise elastic ropes and a depression bar;

one of the elastic ropes is disposed at the first end of the connecting part, and end portions thereof are connected with the base and the indoor part respectively;

the other of the elastic ropes is disposed at the second end of the connecting part, and end portions thereof are connected with the base and the outdoor part respectively; and the depression bar is connected with the connecting part, and the elastic ropes are pressed between the depression bar and the connecting part.

4. The auxiliary mounting device for the saddle type window air conditioner according to claim 1, wherein the damping components each comprise two ropes and two descent control devices connected with the ropes;

the descent control devices on one of the damping components are disposed at the first end of the connecting part, and end portions of the ropes of the one of the damping components are connected with the base and the indoor part; and the descent control devices on the other of the damping components are disposed at the second end of the connecting part, and end portions of the ropes of the other of the damping components are connected with the base and the outdoor part.

5. The auxiliary mounting device for the saddle window air conditioner according to claim 1, wherein the damping components each comprise a first rope, a second rope, and a damping rotating shaft, and the first rope and the second rope are wound on the damping rotating shaft& in opposite directions;

the damping rotating shaft on one of the damping components is disposed at the first end of the connecting part, and end portions of the first rope and the second rope of the one of the damping components are connected with the base and the indoor part respectively; and the damping rotating shaft on the other of the damping components is disposed at the second end of the connecting part, and the end portions of the first rope and the second rope of the other of the damping components are connected with the base and the outdoor part.

6. A mounting method for mounting a saddle window air conditioner using the auxiliary mounting device for the saddle window air conditioner according to claim 1, wherein the mounting method comprises:

mounting one of the damping components to the first end of the connecting part, end portions of the damping component being connected with the base and the indoor part;

mounting the other of the damping components to the second end of the connecting part, the end portions of the damping component being connected with the base and the outdoor part;

moving the saddle window air conditioner to a window together with the auxiliary mounting device, and placing the base on the window, the indoor part being located on an indoor side, and the outdoor part being located on an outdoor side; and causing the connecting part to move gradually towards a direction close to the base with stretching of the damping components.

7. The auxiliary mounting device for the saddle window air conditioner according to claim 3, wherein the depression bar is disposed at a middle position on an upper surface of the connecting part along a length direction of the connecting part, pits are formed at two ends of the depression bar respectively, and the elastic ropes are pressed between the pits and the upper surface of the connecting part.

8. The auxiliary mounting device for the saddle window air conditioner according to claim 3, wherein fixed sheets are disposed on a back plate of the indoor part and a back plate of the outdoor part respectively, first fixing holes are formed in the fixed sheets, and the elastic ropes pass through and are disposed in the first fixing holes; and the base is located above the fixed sheets.

9. The auxiliary mounting device for the saddle window air conditioner according to claim 3, wherein second fixing holes are formed in four corners of the base respectively, and the end portions of the elastic ropes are connected with the second fixing holes.

10. The auxiliary mounting device for the saddle window air conditioner according to claim 1, wherein the damping components comprise two rope components and a depression bar, and each of the two rope components comprises a spring and a first rope and a second rope disposed at two ends of the spring;

the spring a first of the two rope components is disposed at the first end of the connecting part, and end portions of the first rope of the first of the two rope components and the second rope of the first of the two rope components are connected with the base and the indoor part;

the spring on a second of the two rope components is disposed at the second end of the connecting part, and the end portions of the first rope of the second of the two rope components and the second rope of the second of the two rope components are connected with the base and the outdoor part; and the depression bar is connected with the connecting part, and the springs of the two rope components are pressed between the depression bar and the connecting part.

* * * * *